US011738281B2

(12) United States Patent
Sud

(10) Patent No.: US 11,738,281 B2
(45) Date of Patent: Aug. 29, 2023

(54) HYGIENIC STUFFED TOY

(71) Applicant: Shivani Sud, Carrboro, NC (US)

(72) Inventor: Shivani Sud, Carrboro, NC (US)

( * ) Notice: Subject to any disclaimer, the term of this patent is extended or adjusted under 35 U.S.C. 154(b) by 0 days.

(21) Appl. No.: 17/237,823

(22) Filed: Apr. 22, 2021

(65) Prior Publication Data

US 2022/0339550 A1 Oct. 27, 2022

(51) Int. Cl.
*A63H 3/02* (2006.01)
*A63H 9/00* (2006.01)
*A63H 3/28* (2006.01)

(52) U.S. Cl.
CPC ..... *A63H 9/00* (2013.01); *A63H 3/02* (2013.01); *A63H 3/28* (2013.01)

(58) Field of Classification Search
CPC ..... A63H 3/02
See application file for complete search history.

(56) References Cited

U.S. PATENT DOCUMENTS 1,023,401 A 4/1912 Trowbridge
2,636,318 A * 4/1953 Lock ..... A63H 3/02 446/369
4,668,201 A * 5/1987 Stark ..... A63H 3/02 441/88
4,968,281 A * 11/1990 Smith ..... A63H 3/36 446/369
10,631,586 B2 * 4/2020 Brattli ..... A47G 9/1045
2003/0077978 A1 * 4/2003 Beige ..... A63H 3/02 446/369
2003/0236050 A1 * 12/2003 Landry ..... A63H 3/02 446/369
2006/0160458 A1 * 7/2006 Peach ..... A63H 3/02 446/72
2011/0117809 A1 * 5/2011 Bowar ..... A63H 3/005 446/369
2012/0108137 A1 * 5/2012 Sutton ..... A63H 3/005 446/73
2013/0171906 A1 * 7/2013 Smoot ..... A63H 3/003 446/73
2013/0331000 A1 12/2013 Drozdowski
2014/0295730 A1 * 10/2014 Gauci ..... A63H 3/02 446/369

(Continued)

FOREIGN PATENT DOCUMENTS

CN 201969331 9/2011
CN 202044772 11/2011

(Continued)

*Primary Examiner* — John A Ricci
(74) *Attorney, Agent, or Firm* — Taylor English Duma LLP

(57) ABSTRACT

A stuffed toy comprises a body member including an outer layer comprising a waterproof fabric. The outer layer is partially filled with a resilient stuffing material sealingly disposed within the outer layer to provide a predetermined shape to the body member. A shell comprises a flexible fabric having an outer surface and an inner surface. The shell having an opening for receiving the body member through the opening such that the body member is substantially enclosed within and fills the shell, and the shell closely conforming to the body member. The body member is selectively insertable into, and removable from, the shell through the opening in order to provide a predetermined three-dimensional shape to the toy.

18 Claims, 4 Drawing Sheets

(56) References Cited

U.S. PATENT DOCUMENTS

2016/0074760 A1* 3/2016 Parker ..... A63H 3/02
446/72

FOREIGN PATENT DOCUMENTS

| | | |
|---|---|---|
| CN | 101804256 | 9/2012 |
| CN | 202682771 | 1/2013 |
| CN | 203108195 | 8/2013 |
| CN | 206121147 | 4/2017 |
| CN | 211097503 | 7/2020 |
| EP | 3620216 | 3/2020 |
| KR | 20140127962 | 11/2014 |
| WO | 2019090407 | 5/2019 |

* cited by examiner

HYGIENIC STUFFED TOY

BACKGROUND

A soft sculpture for use as a three-dimensional stuffed toy is described and, more particularly, a stuffed toy in the shape of an animal or other fanciful creature wherein components of the stuffed toy may be conveniently sanitized. Furthermore, the stuffed toy is designed to integrate with multiple accessories that enable the toy to adapt for the development and play needs of growing children.

Many different types of stuffed toys, whether it be stuffed animals, stuffed dolls or other figures, have long been used for children. A teddy bear, for example, is a favorite. The teddy bear is provided to children as a play toy and so they can have a companion that can be kept physically close even while sleeping. A child may also derive comfort from a stuffed toy, which can bring physical comfort to a child as both a playmate and companion, as well as when the child is in distress.

Historically, stuffed toys are formed from plush or synthetic textile shells stuffed with a soft material, such as cotton, wool, synthetic fiber, plastic pellets or beans and may contain sound modules or electronics. Most conventional stuffed toys are not recommended to be laundered in a washing machine and a dryer for multiple reasons. First, the stuffing materials hydrate when they are submersed in water and typically become denser, thereby altering the shape and fullness of the stuffed toy. Second, exposure to water causes embedded materials such as sound modules, electronics, rattles, squeakers or other devices to cease to function. Third, placement in a heated dryer can cause "dryer damage", including matting and melting of plush fur. To prevent dryer damage, air-drying is typically recommended; however, this often results in incomplete drying and offers a moist environment for bacteria and mold to grow. As a result, stuffed toys are typically limited "spot clean only" or "surface wash only" as their design does not enable the entire toy to be cleaned at one time.

Typically, plush toys are unable to adapt as children grow. A stuffed toy may come with a permanently embedded feature such as a rattle, squeaker or sound module with pre-recorded audio depending on the age of the child. Resultantly, a plush toy may quickly cease to be age appropriate and customers may purchase multiple plush toys with individual functions as a child ages causing potentially negative economic and environmental impacts.

For the foregoing reasons, there is a need for a stuffed toy that may be sanitized and can adapt as children grow. The components of the stuffed toy should be made of materials configured to allow thorough cleaning to overcome the noted sanitary and hygienic challenges. The cleaning may include a simple wiping down as well as up to, and including, laundering of certain of the components of the stuffed toy. Ideally, the stuffed toy will also have features to enable compatibility with multiple interchangeable integrations depending on the child's age such as rattles, squeakers, sound modules, Bluetooth speakers or other communication devices that can be protected during the sanitation process without requiring removal.

SUMMARY

A stuffed toy is provided, comprising a body member including an outer layer comprising a waterproof fabric, the outer layer partially filled with a resilient stuffing material sealingly disposed within the outer layer to provide a predetermined shape to the body member. A shell comprises a flexible fabric having an outer surface and an inner surface. The shell has an opening for receiving the body member through the opening such that the body member is substantially enclosed within and fills the shell, and the shell closely conforms to the body member. The body member is selectively insertable into, and removable from, the shell through the opening in order to provide a predetermined three-dimensional shape to the toy.

In one aspect, the body member has a torso portion, and a head portion projecting from the torso portion. The body member may also have one or more appendages projecting from the torso portion. Similarly, the shell may have a torso portion, and a head portion projecting from the torso portion, as well as one or more appendages projecting from the torso portion. Upon insertion of the body member into the shell, the portions of the body member fill the corresponding portions of the shell to provide a predetermined shape to the particular portion. In one embodiment, the one or more appendages include two arms and two legs projecting outwardly from the torso. The head portion of the shell may comprise a facial image applied to the outer surface of the shell so as to be visible externally of the stuffed toy. The one or more appendages comprises an ear or a tail.

In one embodiment, the flexible material of the shell is a textile fabric, which may be a plush fabric. The stuffing may comprise a compressible material.

In another aspect, the stuffed toy comprises means for releasably fastening the edges of the shell defining the opening for sealing the opening, such as, for example, complementary strips of hook and loop fasteners.

In still another aspect, the stuffed toy may further comprise a loop affixed to the outer surface of the shell.

In another embodiment, the body member defines a cavity for receiving and storing a speaker or a rattle within the body member.

The stuffed toy may further comprise a bag enclosing beads, the bag affixed to an area of the body member for providing a predetermined weight to the area, wherein the stuffed toy is configured to stay seated or standing in an upright position without external assistance. The area may be the distal end of an appendage.

In yet another aspect, the inner surface of the shell with the opening in a closed position defines a first volume, and wherein the body member is filled with the stuffing material such that the volume of the body member is greater than the first volume. The body member also defines an inner volume, and the body member may be filled with the stuffing material such that the inner volume of the body member is greater than the uncompressed volume of the stuffing material.

BRIEF DESCRIPTION OF THE DRAWINGS

For a more complete understanding of the stuffed toy, reference should now be had to the embodiments shown in the accompanying drawings and described below. In the drawings.

DESCRIPTION

Figure 1:
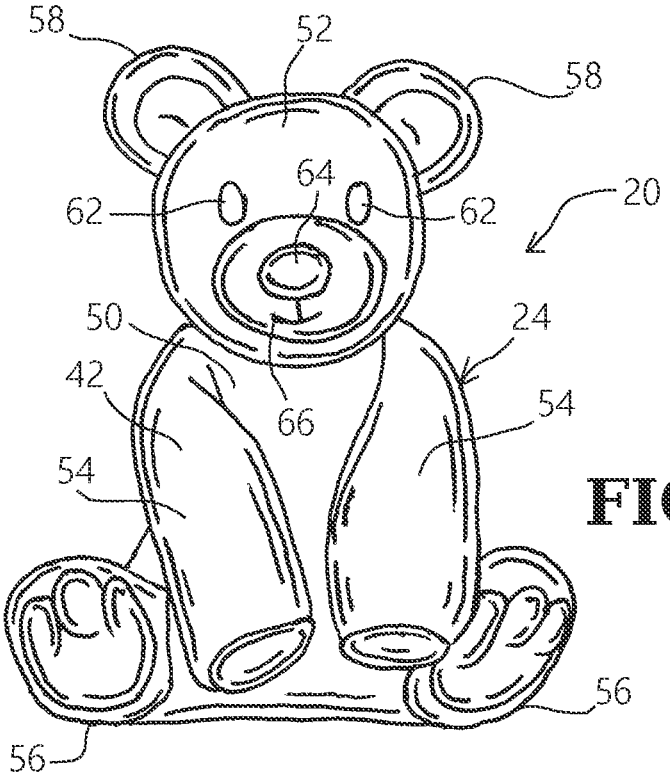
FIG. 1 is a front elevation view of an embodiment of a stuffed toy.
Figure 2:
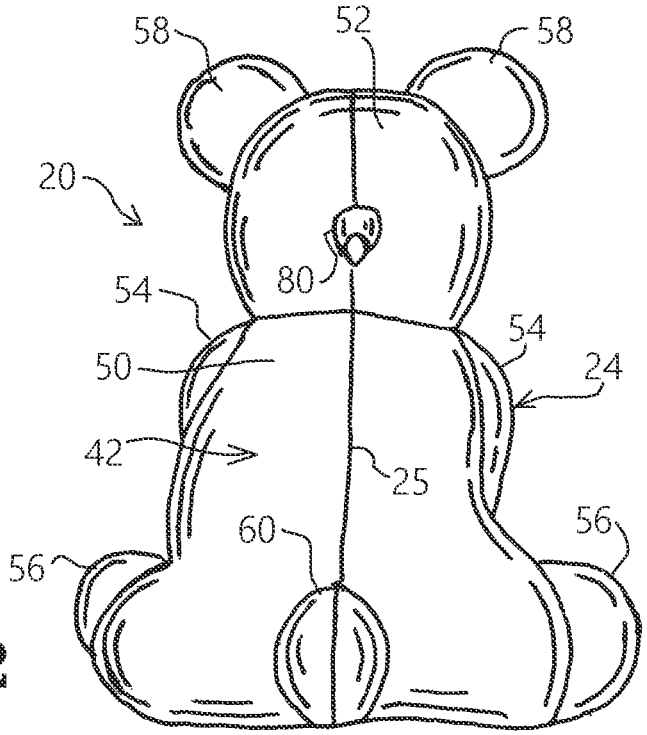
FIG. 2 is a rear elevation view of the stuffed toy as shown in FIG. 1 in a first closed position.

Referring now to the drawings, wherein like reference numerals identify the same or similar elements throughout the several views, an embodiment of a soft sculpture is shown in the form of a stuffed toy, which is generally designated at 20. The stuffed toy 20 comprises an inner body member 22 and an outer shell 24 for the body member. The shell 24 has an opening 25 for receiving the body member 22 through the opening such that the body member is substantially enclosed within the shell. FIGS. 1 and 2 show the stuffed toy 20 in a first sitting disposition with the body member 22 disposed within the shell 24, which conforms closely to the body member 22. In this disposition, the body member 22 functions as a filler for the shell 24 to give the stuffed toy 20 a three-dimensional form. The body member 22 is selectively removable through the opening 25 of the shell 24 such that, in a second disposition, the body member 22 and shell 24 are separated.

Figure 5:
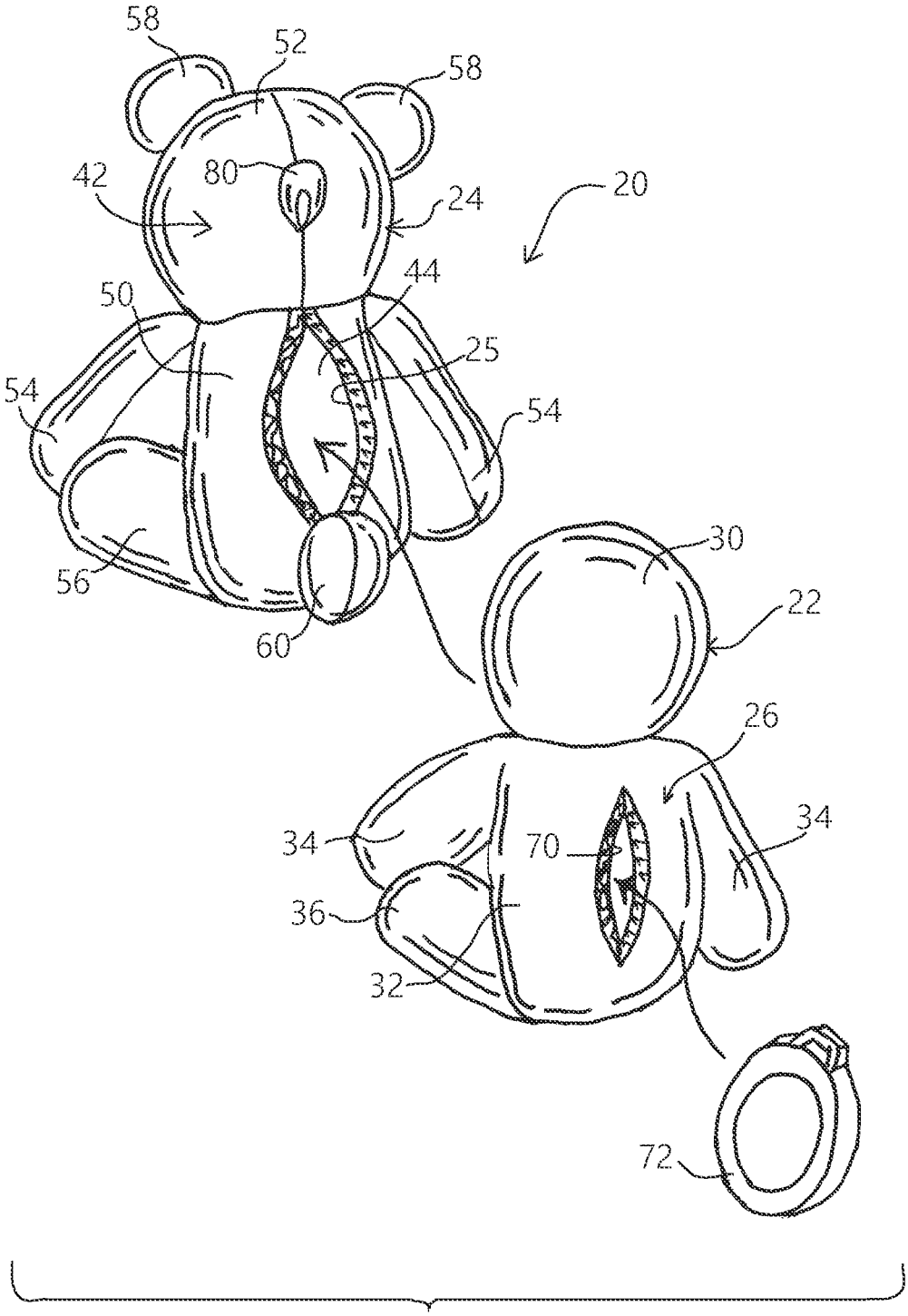
FIG. 5 is an exploded rear perspective view of the stuffed toy as shown in FIG. 1.
Figure 6:
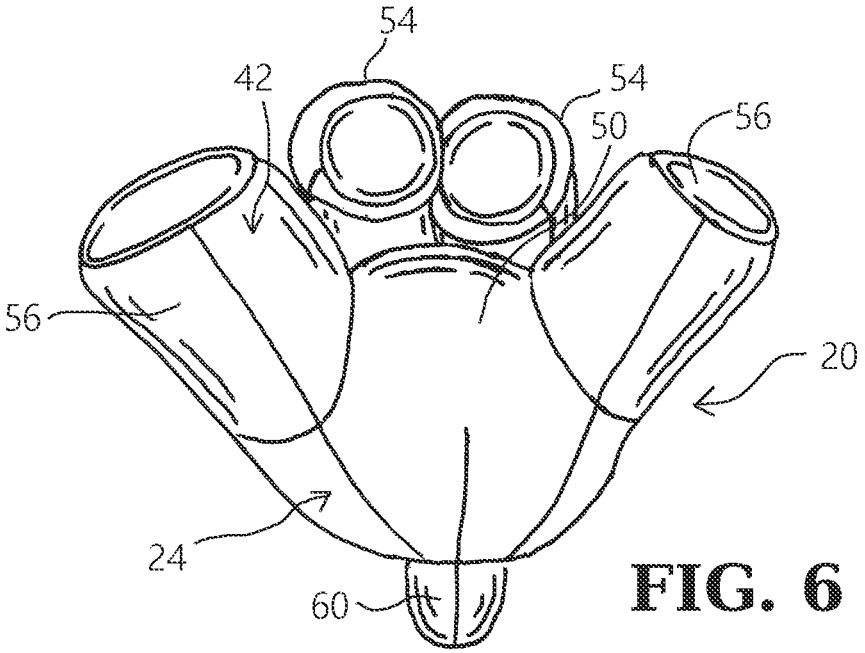
FIG. 6 is a bottom plan view of the stuffed toy as shown in FIG. 1 in a first closed position.
Figure 7:
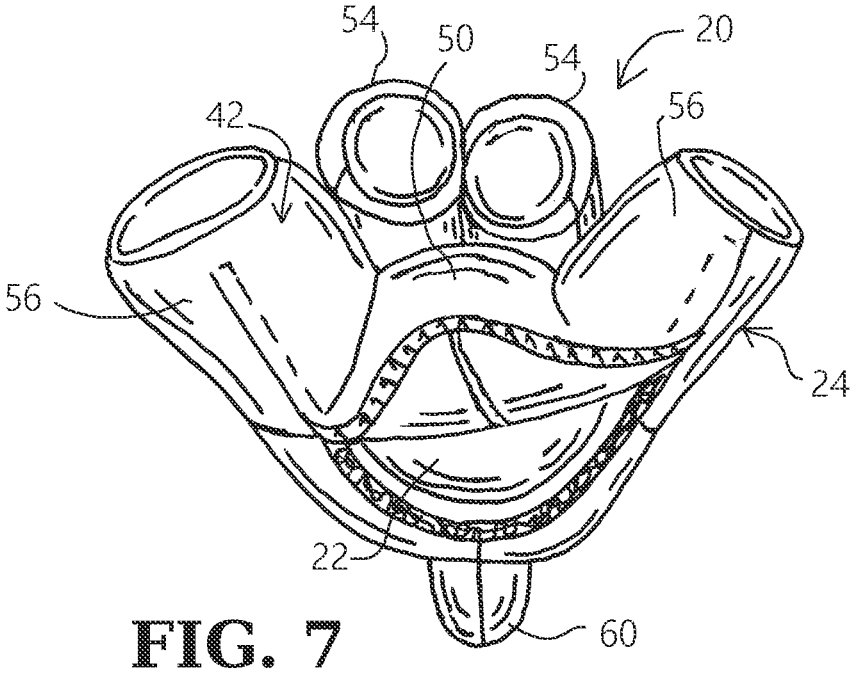
FIG. 7 is a bottom plan view of the stuffed toy as shown in FIG. 6 in a second open position.

Referring to FIG. 5, the body member 22 is a three-dimensional element comprising an outer layer 26 filled with a compressible, resilient stuffing material (not shown). In one embodiment, the outer layer 26 of the body member 22 comprises a waterproof, washable textile fabric material that is sewn closed to define, or otherwise form, an open interior volume or body cavity for holding the stuffing. The stuffing material is sealingly disposed within the waterproof outer layer 26. Non-limiting examples of suitable materials for the outer fabric layer 26 include woven or non-woven fabric made from natural materials, such as cotton, cloth, pile textiles, terrycloth or combinations thereof. The body member 22 may be formed from two or more pieces, or panels, of the material secured together along the edges thereof. The means for securing the panels may be by stitching to form a seam, thermally or heat sensitive adhesive or the like.

The interior volume of the body member 22 is filled with the stuffing material in order to provide a predetermined shape to the body member. The compressible stuffing material is also sufficiently resilient to maintain the shape of the imaginative creature or object depicted by the stuffed body member 22 after release of a compression force. Non-limiting examples of suitable stuffing material include synthetic fiber batting, polyester fleece, shredded soft foam plastic resin, cotton, straw, wood wool, plastic pellets, beans or other natural and synthetic fibers. The size of the stuffed toy 20, as well as the quantity and nature of the stuffing material, may be altered as desired, for example, to meet specific design requirements or intended applications.

The body member 22 may optionally be formed to include, for example, a head portion 30 separate from a body portion 32. The head portion 30 and the body portion 32 of the stuffed toy 20 can be further adorned with one or more appendages comprising, for example, an arm 34, a leg 36, an ear 38 or a tail 40. In at least some embodiments, the head portion 30, the body portion 32 and appendages 34, 36, 38, 40 are integrally formed as a one-piece unitary structure. Alternatively, the head portion 30, the body portion 32 and appendages 34, 36, 38, 40, individually and in any combination, may be fabricated separately and subsequently attached together. The appendages 34, 36, 38, 40 may be of the same general construction as the head portion 30 and the body portion 32 and may be affixed by stitching to the head portion or the body portion, or by any other suitable means.

The removable shell 24 (FIGS. 4 and 5) may comprise a flexible, washable textile fabric having an outer surface 42 and an inner surface 44. In one embodiment, the material of the outer surface 42 of the shell 24 is preferably a plush material resembling an external appearance of animal fur or skin. As described above, the shell 24 has an opening 25 for receiving the body member 22. Means may be provided for releasably fastening the edges of the shell 24 defining the opening 25 for sealing the opening. The fabric of the shell 24 may be formed in a unique shape, including a torso portion 50, a head portion 52 extending from the torso portion and a plurality of appendages or extremities projecting outwardly from the torso portion. The size and shape of the shell 24 is made to correspond to the shape of the body member 22 which, as described above, may include the head portion 30, the body portion 32 and the appendages 34, 36, 38, 40. Insertion of the body member 22 into the shell 24 via the opening 25 fills the corresponding portions of the shell to give a predetermined form to the particular area and to the stuffed toy 20 itself.

Figure 4:
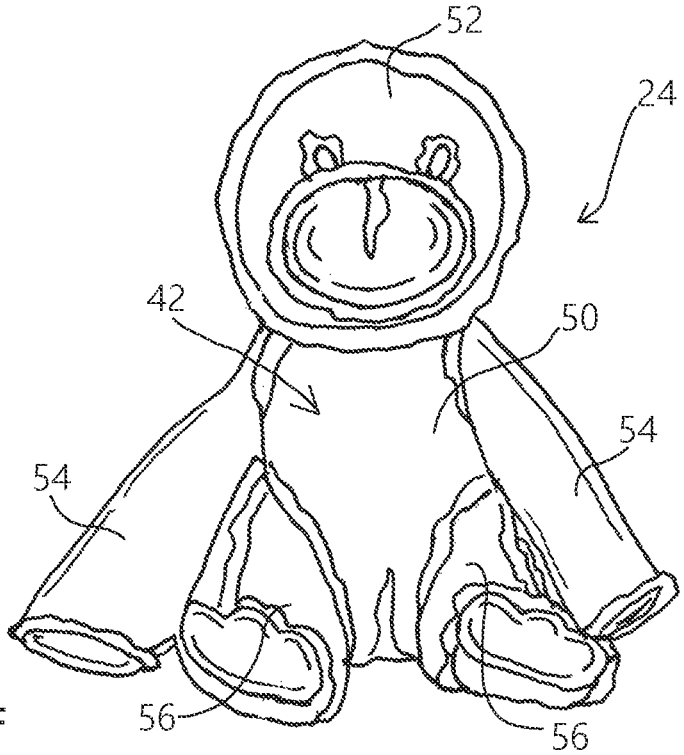
FIG. 4 is a top plan view of an embodiment of an outer shell for use with the stuffed toy shown in FIG. 1 showing the outer surface.

Referring to FIG. 4, the outer surface 42 of the head portion 52 of the shell 24 may be an image bearing surface having a facial image applied or affixed thereto so as to be visible externally of the stuffed toy 20. The facial image is preferably applied by embroidery or screen printing to the image bearing surface of the head portion 52. Alternatively, the facial image may be affixed to the image bearing surface by securing facial features to the head portion 52 such as by adhesive, stitching or the like. The shell 24 of the stuffed toy 20 can be further adorned with detail to one or more of the appendages comprising, for example, an arm 54, a leg 56, an ear 58 or a tail 60.

In the embodiment shown in the drawings, the stuffed toy 20 is a stuffed animal, namely a teddy bear in a seated position. In this embodiment, the stuffed toy 20 includes a shell 24 having bear-shaped torso 50, a head 52 extending from an upper "neck" portion of the torso, and four appendages or limbs 54, 56 also projecting outwardly from the torso. As best seen in FIGS. 1 and 2, the head 52 may be provided with simulated eyes 62, a nose 64 and a mouth 66, as well as the ears 58 projecting from opposite sides of the head 52, all of which can be cooperatively configured to convey the aforementioned teddy bear theme. Projecting from laterally spaced "shoulder" portions of the torso 50 are two elongated arms 54, each of which may include a corresponding paw at a distal end thereof. First and second legs 56, respectively, project outwardly from respective "hip" portions of the torso 50. Like the arms 54, the legs 56 may each be provided with a corresponding paw at a distal end thereof. Depending on the intended form of the stuffed toy 20, the body member 22 may include greater or fewer than four appendages, each of which may take on similar or differing forms than those shown in the drawings, such as horns, wings, tails, and the like.

In order to create decorative details, such as "toes" or "fingers" on the stuffed toy 20, a small amount of stuffing material can be secured to the inner surface of the shell 24 and stitched in place. Carefully placed stitches are pulled tightly to draw the fabric and underlying stuffing to make the material pucker or compress underneath the stitch. This is conventionally referred to as "needle sculpting", which is a means to add contours to a surface. For example, distinctive facial contours can be added to the shell 24 to represent a rabbit, which has a unique head shape. The volume of stuffing is selected so as not to affect the ability to wash and dry the shell 24 in a conventional laundering step. This configuration also allows these decorative elements without binding together the body member 22 and the shell 24 with stitch work. In one embodiment, the stuffing material is first wrapped in a fabric satchel and then stitched into place in the shell 24. In this arrangement, the stuffing material does not move around when the outer shell 24 is being laundered.

While the illustrated embodiment of the stuffed toy 20 resembles a teddy bear, it should be understood that the novel aspects and features of this disclosure can be incorporated into any other stuffed toy, including stuffed toys that assume other shapes that are suitable for a child, including animal or object, insect and human-like "doll" forms or characters, whether real or imaginative, extinct, fictional, mythical, fantastic, etc., as well as other objects and forms, and that all such forms are within the scope and spirit of the stuffed toy 20 as described herein.

Figure 3:
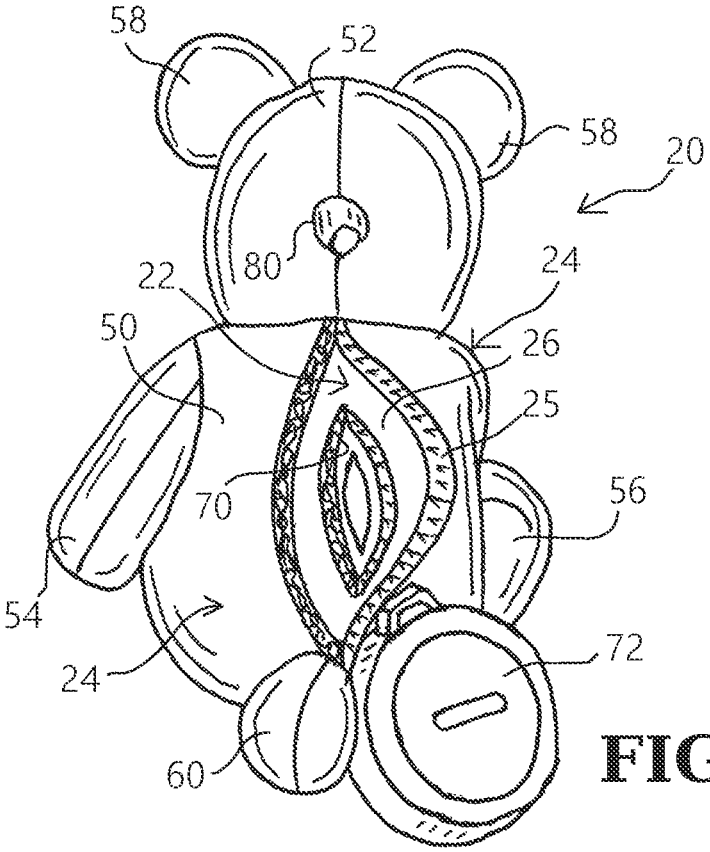
FIG. 3 is a rear elevation view of the stuffed toy as shown in FIG. 2 in a second open position showing a speaker.

In one embodiment best seen in FIG. 3, the body member 22 has an opening 70 for receiving and storing a speaker 72 or other sound-generating device or smart device within the body member. The opening 70 defines an internal cavity or pocket within the body member 22 for receiving the speaker 72 or other object, such as a rattle. The speaker 72 is stored substantially enclosed within the body member 22. This design protects the speaker 72, preventing liquids and soil from reaching the internal filling. The speaker 72 can be used to access audio content such as music and stories. The speaker 72 may be in the form of a battery powered miniature low-fidelity speaker with an activation mechanism, such as a binary switch. The activation mechanism is configured to cause the sound-generating device to output an audible sound, which may be pre-recorded sounds, a soothing voice or music composition, a recording of the voice of the child's mother or father, and the like. Operative communication between the speaker 72 and an input source, such as a microphone, may be by wireless communication, such as with a Bluetooth wireless communication transceiver, for example. With the speaker 72 within the interior volume of the body member 22 surrounded by stuffing material, the figure maintains its plushness, which is not detracted by rigid or hard objects in the interior. The speaker 72 is easily accessible and does not distort the stuffed toy 20. The speaker 72 is removable through the opening 70 of the body member 22 for cleaning, repair or replacement, which allows for complete disinfection and laundering of the components of the stuffed toy 20.

The body member 22 includes a fastening means 74 for opening and closing access to the pocket in the body member. Non-limiting examples of suitable fastening devices include a zipper, hook and loop material, belt, button, snap fastener, and any combination thereof. In one embodiment, when the body member 22 is within the shell 24, the respective openings 25, 70 in the body member 22 and the shell 24 are aligned through the backs of the body member and the shell as shown. This allows access to the pocket for removal or insertion of the speaker 72 without removing the shell 24 from the body member 22. It is understood that the opening 70 and the speaker 72 may be disposed within other locations of the stuffed toy 20, such as one of the appendages. It is further understood that other sound-generating devices or smart devices may be stored within the pocket of the body member 22 including, but not limited to, rattles, squeakers, blue tooth trackers ("tiles") to help locate the stuffed toy, white noise makers, keepsakes and the like.

A loop 80 may be fixably attached to an upper end portion of the shell 24, for example, behind the ears 58, such as by stitching for carrying or hanging the stuffed toy 20 on a hook or with a carabineer. The carrying loop 80 may be permanently or releasably attached to the stuffed toy 20.

In use, the body member 22 is disposed within and substantially fills the outer shell 24. In one embodiment, the body member 22 is the same size or slightly larger than the outer shell 24. In addition, the body member 22 can be slightly under filled with stuffing. This configuration ensures that the body member 22 "fills out" the outer shell 24 and yet remains compressible. Because air does not easily leave the interior volume of the waterproof body member 22, this configuration provides room for the stuffing material to compress and create a soft feel. When the stuffed toy 20 needs to be washed, the outer shell 24 is removed from the body member 22 of the stuffed toy 20 so that the components can be separately washed and dried. For example, the waterproof body member 22 can be wiped with disinfectant. The outer shell 24 can be separately laundered in a conventional manner. The clean stuffed toy 20 is then subsequently re-assembled.

According to one embodiment, the stuffed toy 20 can be configured to remain in an upright seated position (as shown in the drawings), an upright standing position, or any other desired position or orientation without external assistance. An internal support structure may be is designed to retain the stuffed toy 20 in the desired position without the stuffed toy 20 being held or otherwise manually manipulated. Alternatively, the compressibility and resilience of the stuffing material, the stiffness of the material of the outer shell 24, or a combination thereof, may be configured to retain the stuffed toy 20 in the desired position. In one embodiment, beads may be added to, for example, bottom portions or the appendages to, for example, facilitate a sitting position and dangling of the arms when the toy is held up. In this embodiment, beads are stitched to an inner surface of the body member 22 in a small mesh bag. Fixing the beads to the inside surface of the waterproof body member provides an extra barrier layer between the user and the beads for safety.

The stuffed toy 20 has many advantages, including separation of the ornamental, decorative components from those containing stuffing for washing. The stuffing is contained within the waterproof shell of the inner body. This configuration facilitates convenient cleaning of the stuffed toy, resulting in a hygienic and sanitary companion for a child. The stuffed toy 20 could be modular in the sense that the same inner body member 22 may be used with interchangeable outer shells 24. The interchangeable shells 24 can create many characters using the same body member 22 while changing the shell 24 to alternate between seasonal characters. For example, instead of having separate seasonal animals for holidays like Easter, Halloween, Christmas, there could be one inner body member 22 and, according to the holiday season, the outer shell of a bunny, witch or reindeer, respectively, could be applied. In order to accomplish modularity, the inner body member 22 would be amorphous and loosely filled with stuffing so that it could be shaped to fit a variety of animal shapes.

Although the present invention has been described in considerable detail with reference to certain preferred versions thereof, other versions are possible. For example, the soft sculpture can be of any size or shape resembling any real or imaginative creature or object. The material of construction of the soft sculpture can be any flexible, resilient material including cloth, fabric, plastic and the like, or a foam-like fabric with no need for padding to give the soft sculpture its desired shape. Additionally, as an alternative to stitching, the material may secured together using thermally or heat sensitive adhesive. Therefore, the spirit and scope of the appending claims should not be limited to the description of the preferred versions of the stuffed toy contained herein.

I claim:

1. A stuffed toy, comprising:

a body member including an outer layer comprising a waterproof fabric, the body member defining an inner volume filled with a resilient stuffing material such that the inner volume of the body member is greater than the uncompressed volume of the stuffing material, the resilient stuffing material sealingly disposed within the outer layer to provide a predetermined shape to the body member; and a shell comprising a flexible fabric having an outer surface and an inner surface, the shell having an opening for receiving the body member through the opening such that the body member is substantially enclosed within and fills the shell, the shell closely conforming to the body member, wherein the inner surface of the shell with the opening in a closed position defines a first volume such that the uncompressed volume of the body member filled with the resilient stuffing material is greater than the first volume, wherein the body member is selectively insertable into and removable from the shell through the opening in order to provide a predetermined three-dimensional shape to the toy.

2. The stuffed toy as recited in claim 1, wherein the body member has a torso portion, and a head portion projecting from the torso portion.

3. The stuffed toy as recited in claim 2, wherein the body member has one or more appendages projecting from the torso portion.

4. The stuffed toy as recited in claim 3, wherein the shell has one or more appendages projecting from the torso portion, wherein upon insertion of the body member into the shell the portions of the body member fill the corresponding portions of the shell to provide a predetermined shape to the particular portion.

5. The stuffed toy as recited in claim 4, wherein the one or more appendages includes two arms and two legs projecting outwardly from the torso.

6. The stuffed toy as recited in claim 5, wherein the one or more appendages comprises an ear.

7. The stuffed toy as recited in claim 4, wherein the one or more appendages comprises a tail.

8. The stuffed toy as recited in claim 2, wherein the shell has a torso portion, and a head portion projecting from the torso portion, wherein upon insertion of the body member into the shell the portions of the body member fill the corresponding portions of the shell to provide a predetermined shape to the particular portion.

9. The stuffed toy as recited in claim 8, wherein the head portion of the shell comprises a facial image applied to the outer surface of the shell so as to be visible externally of the stuffed toy.

10. The stuffed toy as recited in claim 1, wherein the flexible fabric is a textile fabric.

11. The stuffed toy as recited in claim 1, wherein the flexible fabric is a plush fabric.

12. The stuffed toy as recited in claim 1, wherein the stuffing comprises a compressible material.

13. The stuffed toy as recited in claim 1, further comprising means for releasably fastening the edges of the shell defining the opening for sealing the opening.

14. The stuffed toy as recited in claim 13, wherein the fastening means comprises complementary strips of hook and loop fasteners.

15. The stuffed toy as recited in claim 1, further comprising a loop affixed to the outer surface of the shell.

16. The stuffed toy as recited in claim 1, wherein the body member defines a cavity for receiving and storing a speaker within the body member.

17. The stuffed toy as recited in claim 1, further comprising a bag enclosing beads, the bag affixed to an area of the body member for providing a predetermined weight to the area, wherein the stuffed toy is configured to stay seated or standing in an upright position without external assistance.

18. The stuffed toy as recited in claim 17, wherein the area is the distal end of an appendage.

* * * * *